US010610801B2

(12) United States Patent
Xu

(10) Patent No.: US 10,610,801 B2
(45) Date of Patent: Apr. 7, 2020

(54) SPURTING PANEL AND MACHINE CASE FOR FLAME SIMULATION STAGE FOG SPURTING MACHINE AND FLAME SIMULATION STAGE FOG SPURTING MACHINE

(71) Applicant: GUANGZHOU DJPOWER ELECTRONIC TECHNOLOGY CO., LTD., Guangzhou (CN)

(72) Inventor: Hui Xu, Guangzhou (CN)

(73) Assignee: GUANGZHOU DJPOWER ELECTRONIC TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 16/308,487

(22) PCT Filed: Nov. 9, 2016

(86) PCT No.: PCT/CN2016/105161
§ 371 (c)(1),
(2) Date: Dec. 10, 2018

(87) PCT Pub. No.: WO2017/215184
PCT Pub. Date: Dec. 21, 2017

(65) Prior Publication Data

US 2019/0270028 A1 Sep. 5, 2019

(30) Foreign Application Priority Data

Jun. 15, 2016 (CN) ..... 2016 2 0589441 U

(51) Int. Cl.
*A63J 5/02* (2006.01)
*F21S 10/04* (2006.01)
(Continued)

(52) U.S. Cl.
CPC ..... *A63J 5/023* (2013.01); *A63J 5/025* (2013.01); *F21S 10/04* (2013.01); *F21V 3/00* (2013.01);
(Continued)

(58) Field of Classification Search
CPC . A63J 5/023; A63J 5/025; F21S 10/04; F21V 3/00; F21Y 2115/10; F21W 2131/406
See application file for complete search history.

(56) References Cited

FOREIGN PATENT DOCUMENTS

CN 200966931 Y 10/2007
CN 203108224 * 8/2013 ..... A63J 5/02
(Continued)

*Primary Examiner* — Michael D Dennis
(74) *Attorney, Agent, or Firm* — Bayramoglu Law Offices LLC

(57) ABSTRACT

A flame simulation stage fog spurting machine includes a spurting machine case. A fog juice bottle, a fog juice pump, a heater, a power module, and a control module are mounted inside the spurting machine case. The machine case includes a case body and a spurting panel. The spurting panel is provided with a fog spurting hole connected to a nozzle on the heater, an inner flame spotlight set, and an outer flame spotlight set. A distance between the outer flame spotlight set and the fog spurting hole is greater than a distance between the inner flame spotlight group and the fog spurting hole. The power module supplies power to the heater and the spotlights, etc. The control module is configured to control the working status of the inner flame spotlight set and the outer flame spotlight set.

9 Claims, 12 Drawing Sheets

(51) Int. Cl.
*F21V 3/00* (2015.01)
*F21Y 115/10* (2016.01)
*F21W 131/406* (2006.01)

(52) U.S. Cl.
CPC .... *F21W 2131/406* (2013.01); *F21Y 2115/10* (2016.08)

(56) References Cited

FOREIGN PATENT DOCUMENTS

| | | | | | |
|---|---|---|---|---|---|
| CN | 203108224 | U | | 8/2013 | |
| CN | 203483878 | | * | 3/2014 | ..... A63J 5/02 |
| CN | 203483878 | U | | 3/2014 | |

* cited by examiner

SPURTING PANEL AND MACHINE CASE FOR FLAME SIMULATION STAGE FOG SPURTING MACHINE AND FLAME SIMULATION STAGE FOG SPURTING MACHINE

CROSS REFERENCE TO RELATED APPLICATIONS

This application is the national phase entry of International Application No. PCT/CN2016/105161, filed on Nov. 9, 2016, which is based upon and claims priority to Chinese Patent Application No. 201620589441.4 filed on Jun. 15, 2016, the entire contents of which are incorporated herein by reference.

TECHNICAL FIELD

The present invention relates to a spurting panel and a machine case for flame simulation stage fog spurting machine and a flame simulation stage fog spurting machine, which pertains to the field of stage effect equipment.

BACKGROUND

In general flame simulation stage fog spurting machine, the fog juice that can be rapidly gasified into white gaseous fog after being heated at a high temperature quickly passes through a high-temperature heating pipe to form the white gaseous fog. The white gaseous fog is then spurted from the fog spurting hole on the spurting panel of the fog spurting machine case. The spurted fog is in the shape of a fog channel and is illuminated by LED lights provided on the spurting panel to simulate the flame jet effect. However, in the prior art, the LED spotlights on the spurting panel are mostly configured near the fog spurting hole with the same distances in a centralized manner. The white fog formed by the fog juice is dense before a sufficient diffusion, and the light beams of the LED spotlights located near the fog spurting hole are unable to penetrate through the dense fog, so only the fog channel located close to the fog spurting hole can be illuminated. During the performance, the fog channel can be spurted to a far distance, while the part of the illuminated fog channel that forms a flame effect is far less than the entire fog channel, which is a pity.

SUMMARY

A first objective of the present invention is to provide a spurting panel for a flame simulation stage fog spurting machine that can illuminate a higher fog channel.

A second objective of the present invention is to provide a machine case for a flame simulation stage fog spurting machine that can illuminate a higher fog channel.

A third objective of the present invention is to provide a flame simulation stage fog spurting machine having a better flame simulation effect.

The first objective of the present invention is realized by the following technical solutions.

A spurting panel for a flame simulation stage fog spurting machine, wherein the spurting panel is provided with a fog spurting hole and an inner flame spotlight set. The inner flame spotlight set is mounted on the spurting panel and located around the fog spurting hole. The spurting panel is further provided with an outer flame spotlight set. A distance between the outer flame spotlight set and the fog spurting hole is greater than a distance between the inner flame spotlight set and the fog spurting hole.

The inner flame spotlight set includes at least two spotlights.

The outer flame spotlight set includes at least two spotlights.

The inner flame spotlight set is arc-shaped, annular shaped, or straight strip-shaped.

The outer flame spotlight set is arc-shaped, annular shaped, or straight strip-shaped.

The spotlights are LED spotlights, light bulbs, lasers, or other light sources.

In order not to affect the perfect effect of the fog channel flame due to the reason that the spotlights are visible to the audiences during use, a non-transparent lampshade is mounted on the spurting panel. Both the inner flame spotlight set and the outer flame spotlight set are located inside the lampshade, and a height of the lampshade is slightly greater than or equal to heights of the inner flame spotlight set and the outer flame spotlight set.

The lampshade is further provided with a non-transparent cover plate. The cover plate is located above the inner flame spotlight set and the outer flame spotlight set, or a bottom surface of the cover plate is appressed with the inner flame spotlight set and the outer flame spotlight set.

The cover plate is provided with light-transmitting holes matched with positions and sizes of the fog spurting hole, the inner flame spotlight set, and the outer flame spotlight set. The cover plate is mounted on the lampshade, integrally formed with the lampshade, or connected and mounted to the spurting panel by fasteners.

In order to prevent the lampshade and the spotlights from stains such as dust, droplets, etc., an upper end surface of the cover plate is further provided with a transparent protection plate. The transparent protection plate is provided with a through hole matched with the position and the size of the fog spurting hole. The transparent protection plate is mounted on the lampshade, integrally formed with the lampshade, or connected and mounted to the spurting panel by fasteners.

The second objective of the present invention is realized by the following technical solutions.

A machine case for a flame simulation stage fog spurting machine includes a case body and a spurting panel. The spurting panel is provided with a fog spurting hole and an inner flame spotlight set. The inner flame spotlight set is mounted on the spurting panel and located around the fog spurting hole. The spurting panel is further provided with an outer flame spotlight set. A distance between the outer flame spotlight set and the fog spurting hole is greater than a distance between the inner flame spotlight set and the fog spurting hole.

The inner flame spotlight set includes at least two spotlights.

The outer flame spotlight set includes at least two spotlights.

The inner flame spotlight set is arc-shaped, annular shaped, or straight strip-shaped.

The outer flame spotlight set is arc-shaped, annular shaped, or straight strip-shaped.

The spotlights are LED spotlights, light bulbs, lasers, or other light sources.

In order not to affect the perfect effect of the fog channel flame due to the reason that the spotlights are visible to the audiences during use, a non-transparent lampshade is mounted on the spurting panel. Both the inner flame spotlight set and the outer flame spotlight set are located inside the lampshade, and a height of the lampshade is slightly greater than or equal to heights of the inner flame spotlight set and the outer flame spotlight set.

The lampshade is further provided with a non-transparent cover plate. The cover plate is located above the inner flame spotlight set and the outer flame spotlight set, or a bottom surface of the cover plate is appressed with the inner flame spotlight set and the outer flame spotlight set. The cover plate is provided with light-transmitting holes matched with positions and sizes of the fog spurting hole, the inner flame spotlight set, and the outer flame spotlight set. The cover plate is mounted on the lampshade, integrally formed with the lampshade, or connected and mounted to the spurting panel by fasteners.

In order to prevent the lampshade and the spotlights from stains such as dust, droplets, etc., an upper end surface of the cover plate is further provided with a transparent protection plate. The transparent protection plate is provided with a through hole matched with the position and the size of the fog spurting hole. The transparent protection plate is mounted on the lampshade, integrally formed with the lampshade, or connected and mounted to the spurting panel by fasteners.

The third objective of the present invention is realized by the following technical solutions.

A flame simulation stage fog spurting machine, characterized in that, it includes a spurting machine case. A fog juice bottle, a fog juice pump, a fog juice heater, a power module, and a control module are mounted inside the spurting machine case. An input end of the fog juice pump is connected to the fog juice bottle. An output end of the fog juice pump is connected to the heater. The spurting machine case includes a case body and a spurting panel mounted on the case body. The spurting panel is provided with a fog spurting hole connected to a nozzle on the heater and an inner flame spotlight set mounted on the spurting panel and located around the fog spurting hole. The spurting panel is further provided with an outer flame spotlight set. A distance between the outer flame spotlight set and the fog spurting hole is greater than a distance between the inner flame spotlight set and the fog spurting hole. The inner flame spotlight set, the outer flame spotlight set, and the control module are electrically connected to the power module, respectively. The inner flame spotlight set and the outer flame spotlight set are electrically connected to the control module, respectively. The control module is configured to control working status of the inner flame spotlight set and the outer flame spotlight set.

The inner flame spotlight set includes at least two spotlights.

The outer flame spotlight set includes at least two spotlights.

The inner flame spotlight set is arc-shaped, annular shaped, or straight strip-shaped.

The outer flame spotlight set is arc-shaped, annular shaped, or straight strip-shaped.

The spotlights are LED spotlights, light bulbs, lasers, or other light sources.

In order not to affect the perfect effect of the fog channel flame due to the reason that the spotlights are visible to the audience during use, a non-transparent lampshade is mounted on the spurting panel. Both the inner flame spotlight set and the outer flame spotlight set are located inside the lampshade, and a height of the lampshade is slightly greater than or equal to heights of the inner flame spotlight set and the outer flame spotlight set.

The lampshade is further provided with a non-transparent cover plate. The cover plate is located above the inner flame spotlight set and the outer flame spotlight set, or a bottom surface of the cover plate is appressed with the inner flame spotlight set and the outer flame spotlight set. The cover plate is provided with light-transmitting holes matched with positions and sizes of the fog spurting hole, the inner flame spotlight set, and the outer flame spotlight set. The cover plate is mounted on the lampshade, integrally formed with the lampshade, or connected and mounted to the spurting panel by fasteners.

In order to prevent the lampshade and the spotlights from stains such as dust, droplets, etc., an upper end surface of the cover plate is further provided with a transparent protection plate. The transparent protection plate is provided with a through hole matched with the position and the size of the fog spurting hole. The transparent protection plate is mounted on the lampshade, integrally formed with the lampshade, or connected and mounted to the spurting panel by fasteners.

The present invention has a simple and compact structure. The lower portion of the fog channel of fog can be illuminated by the inner flame spotlight set installed around the fog spurting hole to form a simulated inner cone of flame. The outer flame spotlight set is disposed at a position much farther away from the fog spurting hole, so the light beam of the outer flame spotlight set can avoid the undiffused dense fog channel of the fog in a relatively great extent. As a result, higher and larger part of the fog channel of the fog can be illuminated, and the brightness of the fog channel of fog is improved and the height of the simulated flame is increased, thereby forming the effect of the outer flame in visual sense, and the stage flame has more obvious and impressed effects. By configuring a non-transparent lampshade outside the spotlights, the visual effect would not be affected due to the reason that the structures of the spotlight modules are visible to the audiences. By configuring a transparent protection plate on the lampshade, the lampshade and spotlights can be prevented from stains such as dust, droplets, etc. to the maximum extent while ensuring the light transmission. Meanwhile, by controlling the color of the inner flame spotlight set and the outer flame spotlight set, the fog channel of fog may have a plurality of different colors as the fog channel is spurted, thereby generating a gorgeous effect of multicolor inner flame and multicolor outer flame.

DETAILED DESCRIPTION OF THE EMBODIMENTS

Figure 1:
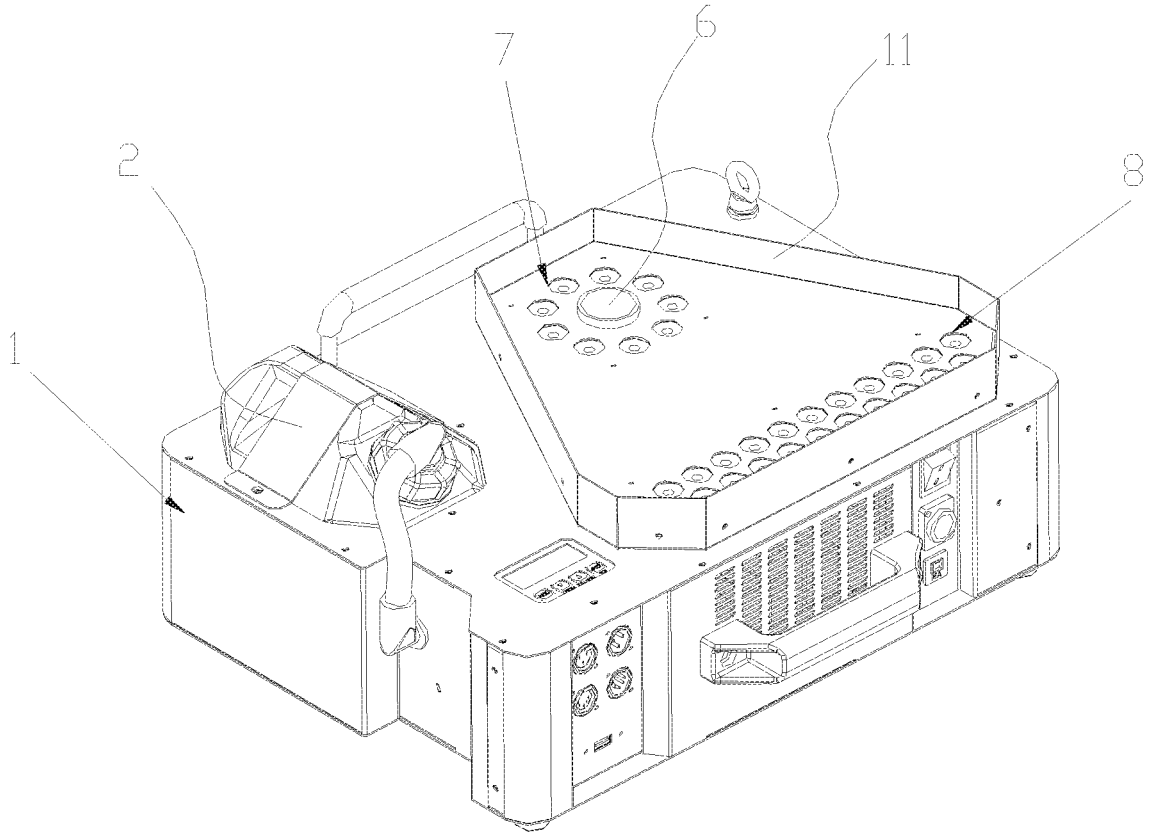
FIG. 1 is a schematic diagram showing the entire flame simulation stage fog spurting machine according to Embodiment 1.
Figure 2:
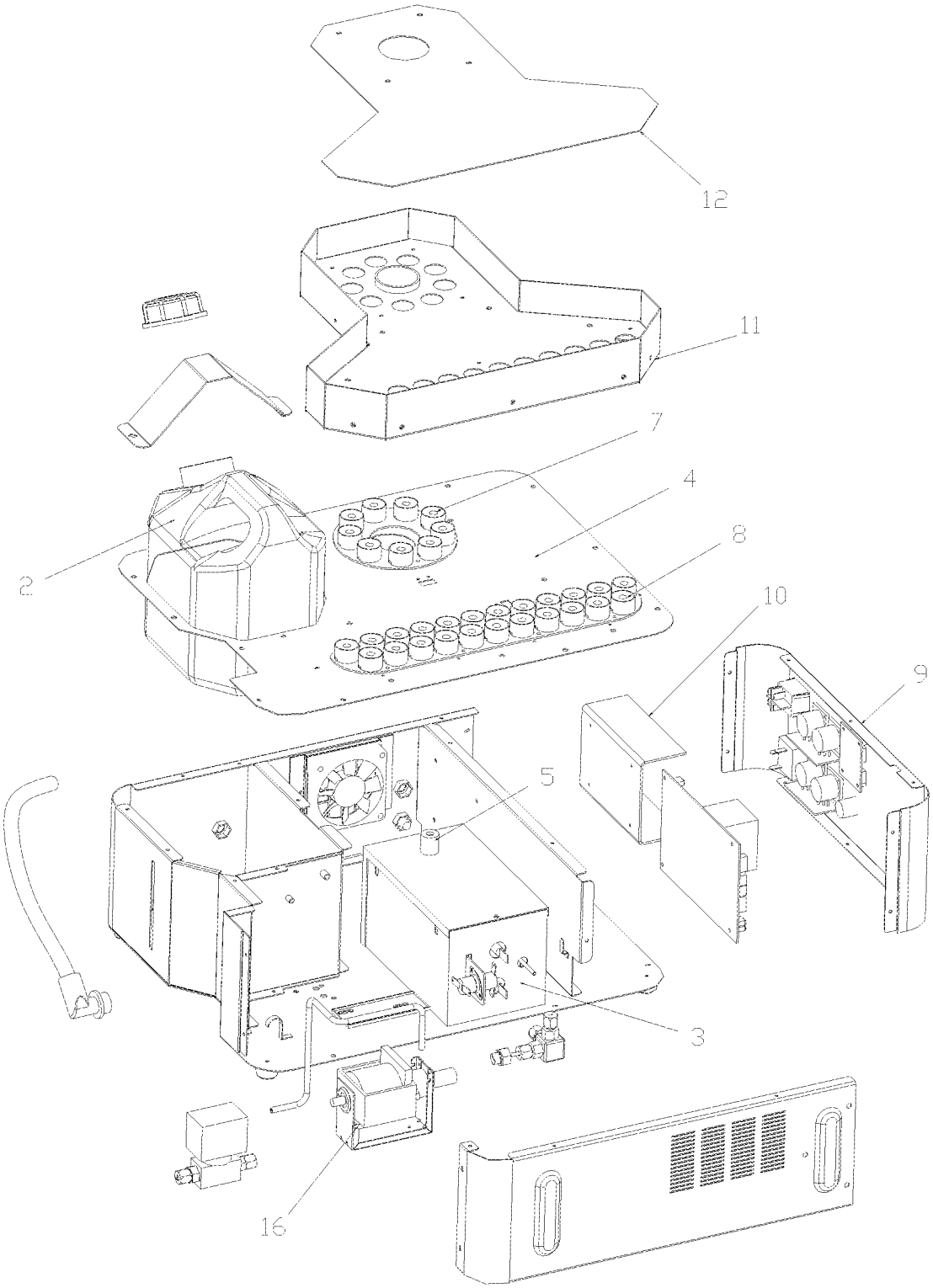
FIG. 2 is an exploded diagram of FIG. 1.
Figure 3:
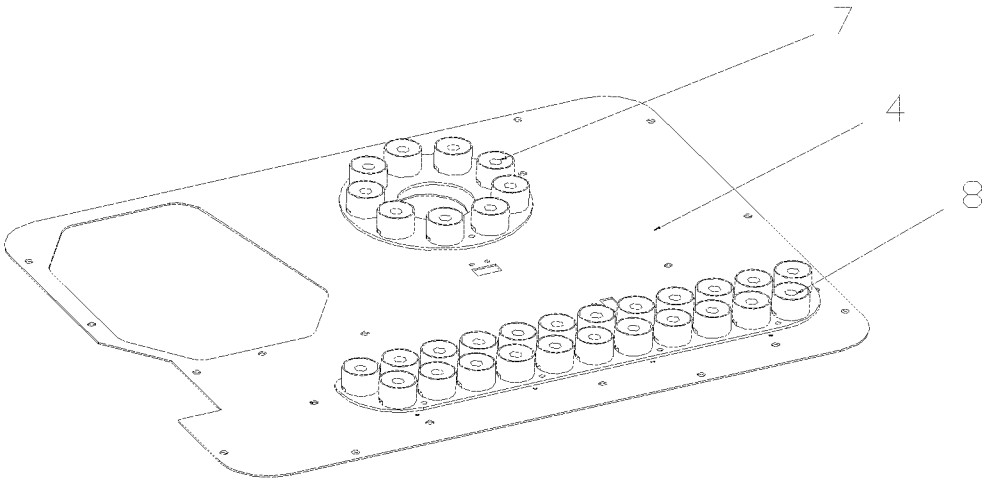
FIG. 3 is a structural schematic diagram of the spurting panel in FIG. 2.
Figure 4:
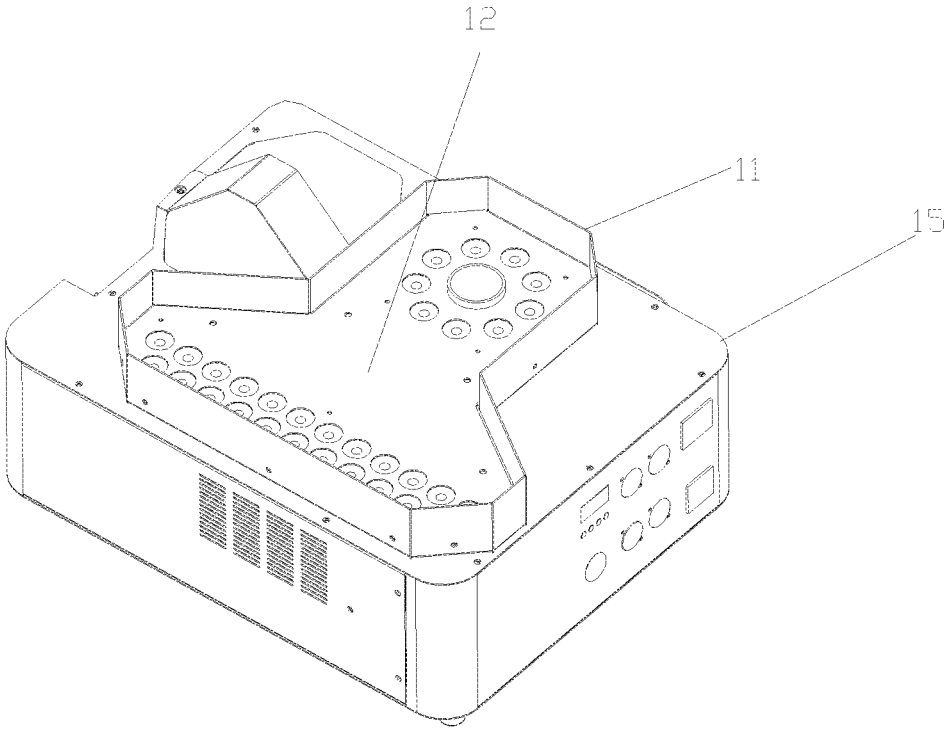
FIG. 4 is a structural schematic diagram of a machine case of Embodiment 1.
Figure 5:
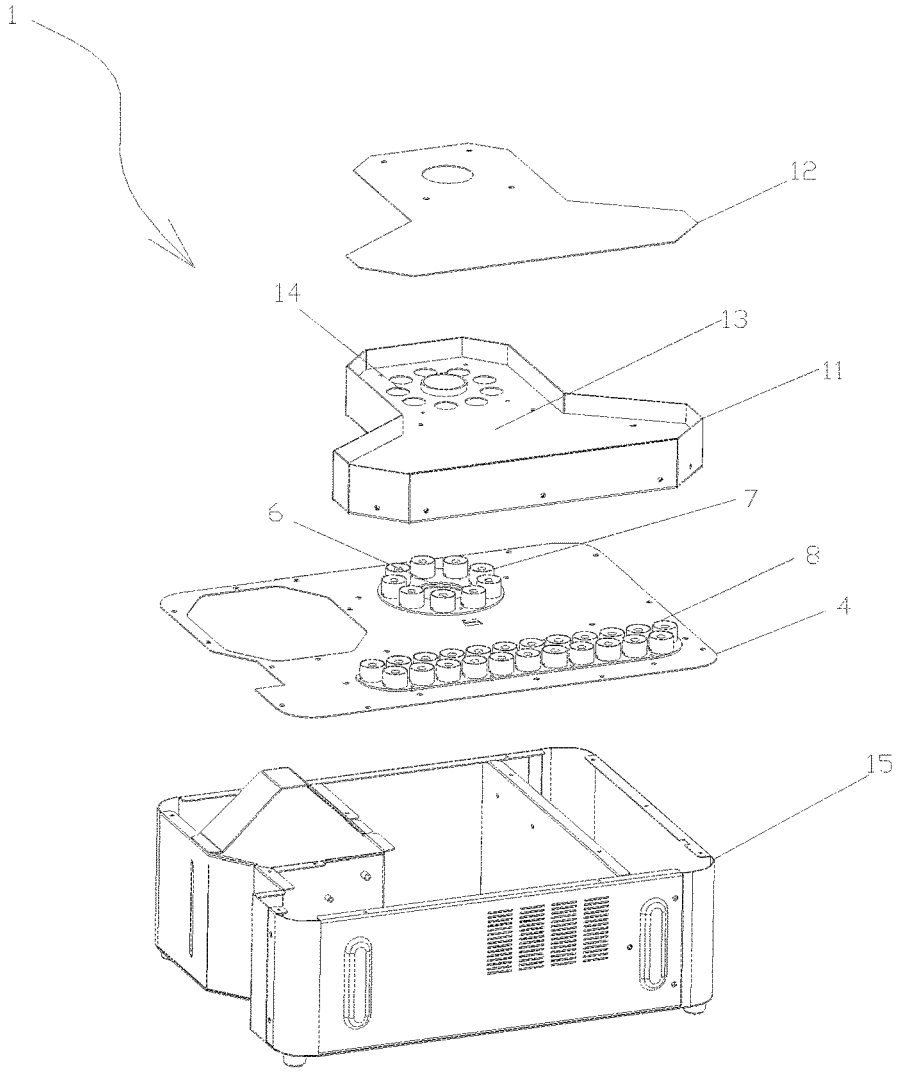
FIG. 5 is an exploded diagram of FIG. 4.
Figure 6:
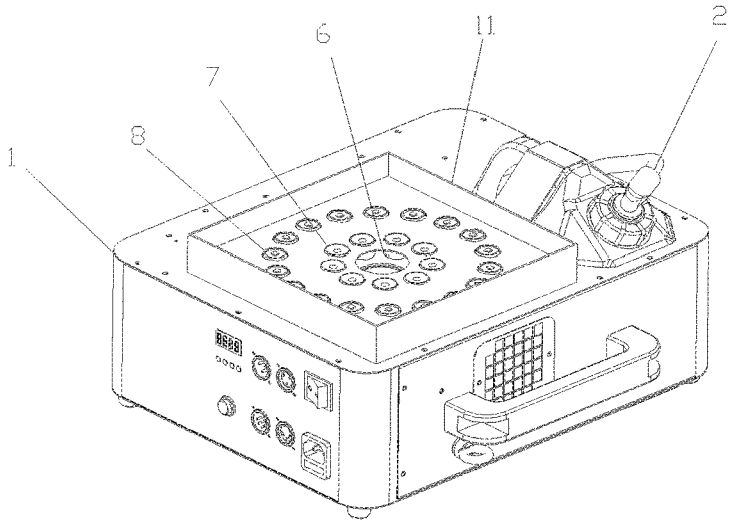
FIG. 6 is a schematic diagram showing the entire flame simulation stage fog spurting machine according to Embodiment 2.
Figure 7:
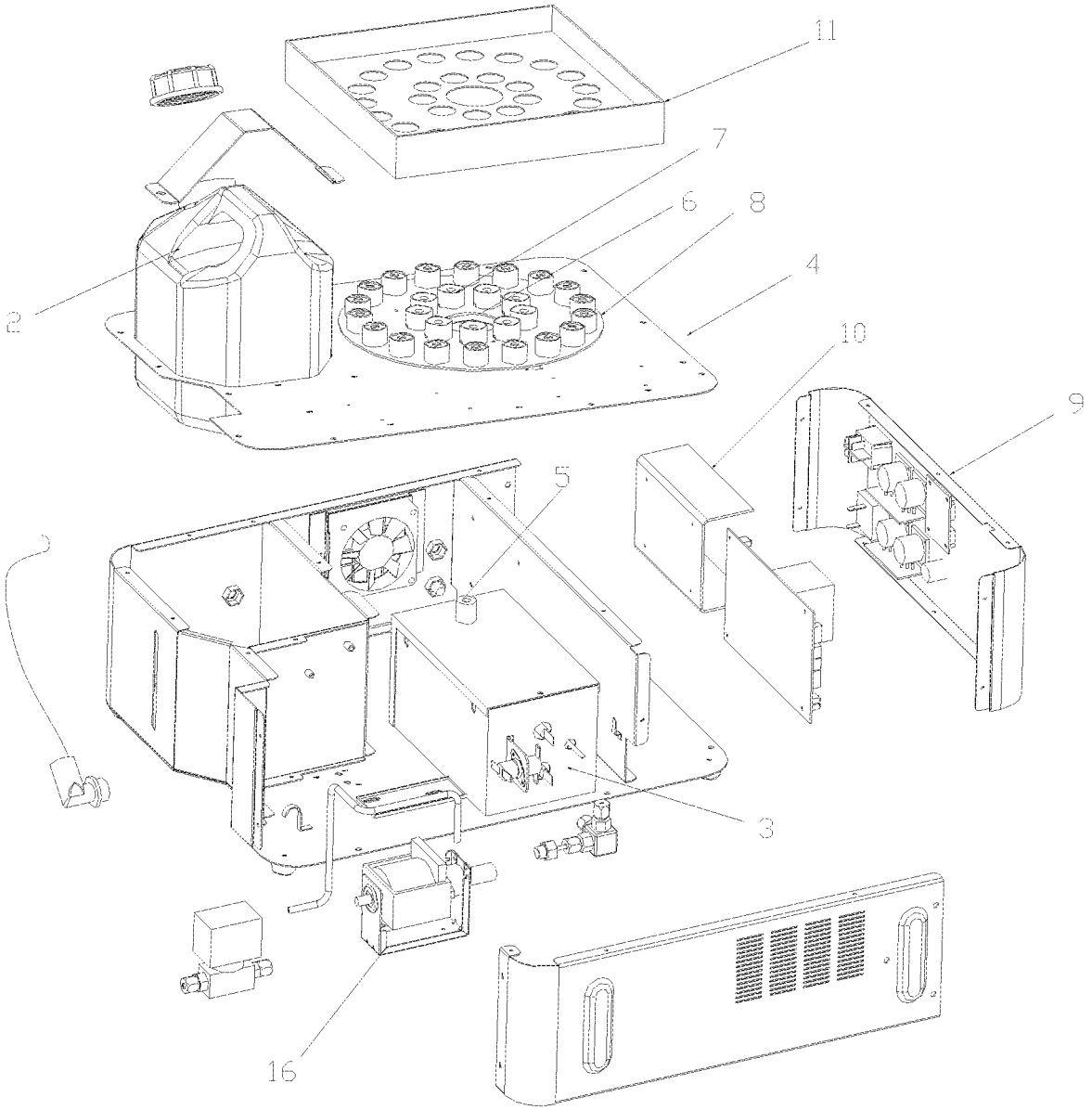
FIG. 7 is an exploded diagram of FIG. 6.
Figure 8:
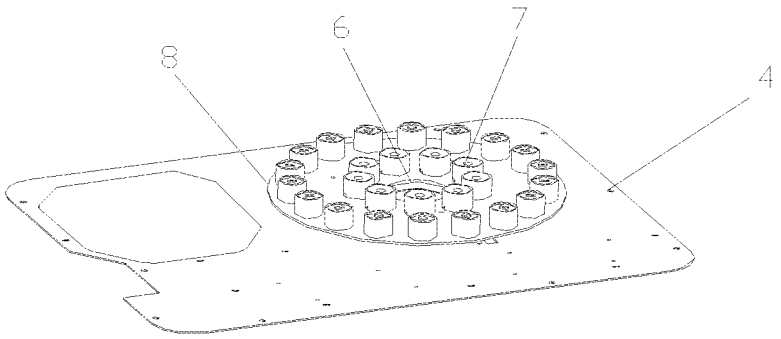
FIG. 8 is a structural schematic diagram of the spurting panel in FIG. 7.
Figure 9:
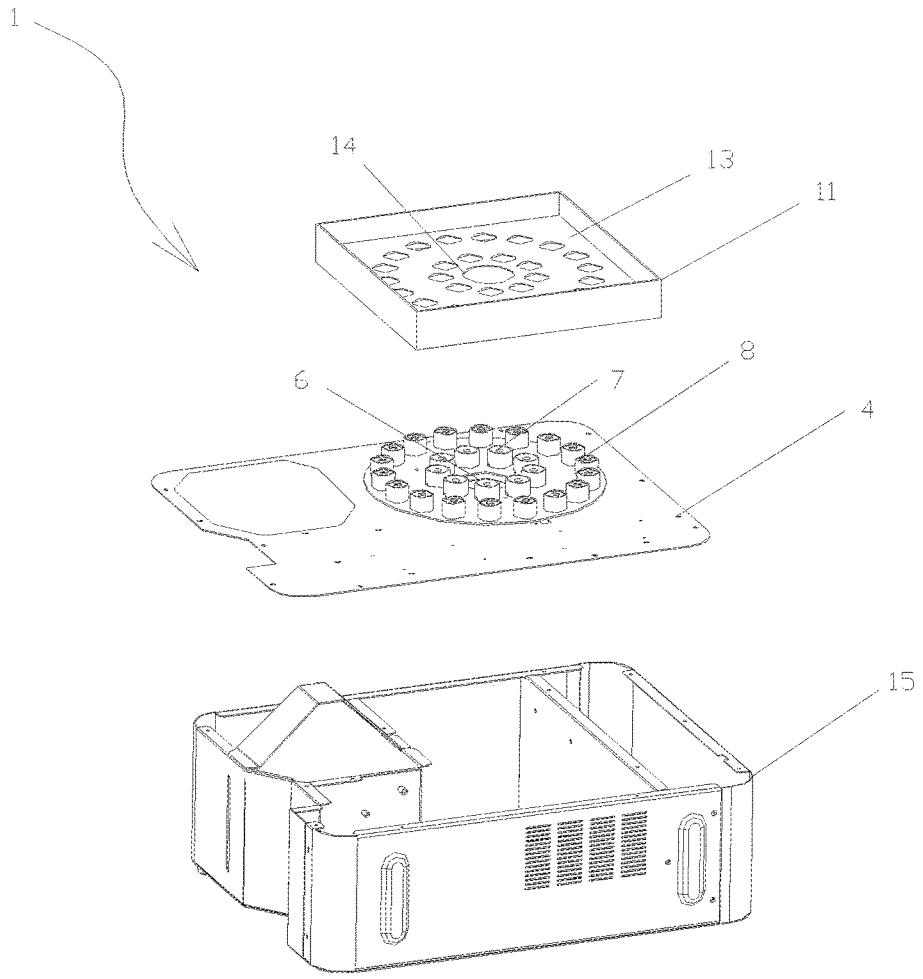
FIG. 9 is an exploded diagram of the machine case of Embodiment 2.
Figure 10:
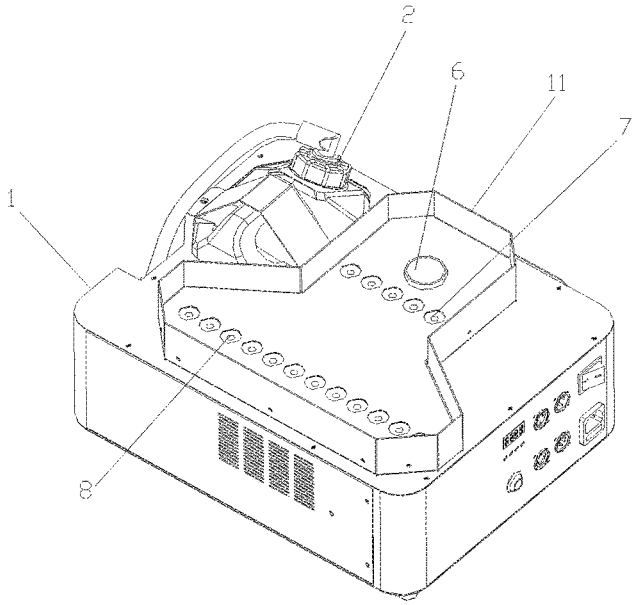
FIG. 10 is a schematic diagram showing the entire flame simulation stage fog spurting machine according to Embodiment 3.
Figure 11:
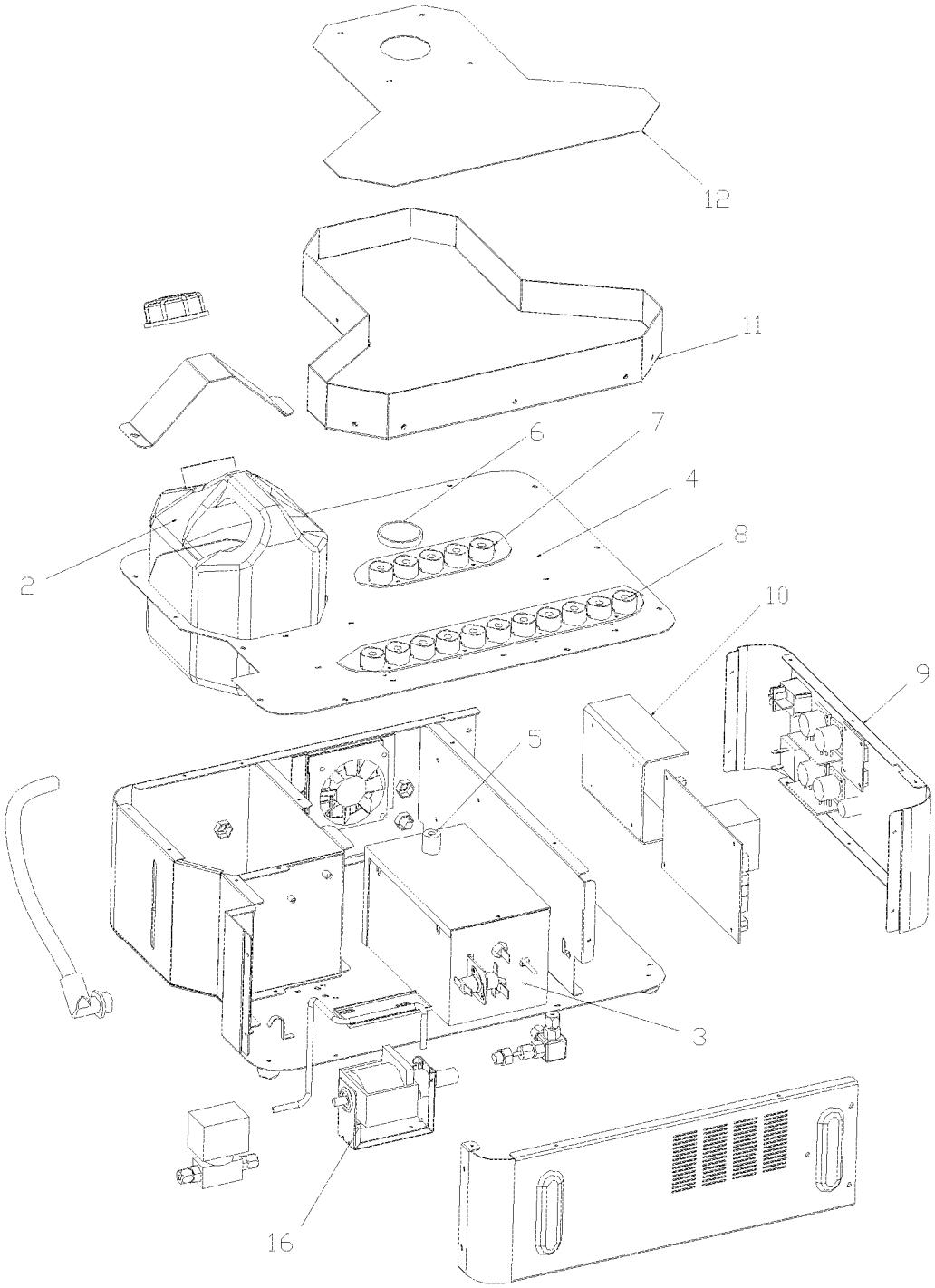
FIG. 11 is an exploded diagram of FIG. 10.
Figure 12:
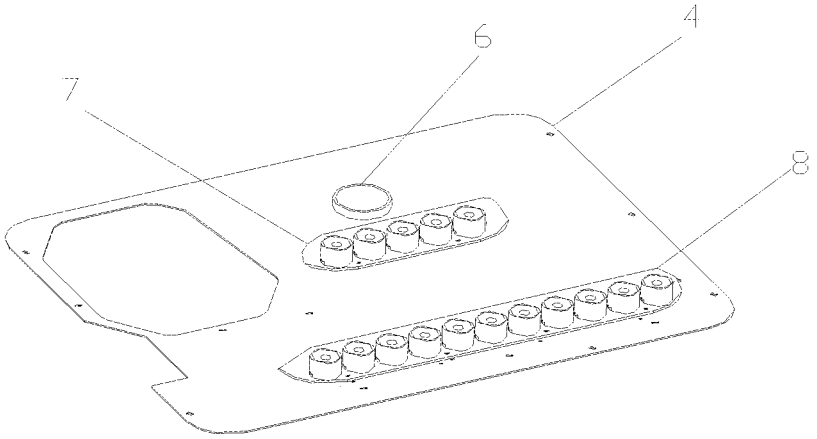
FIG. 12 is a structural schematic diagram of the spurting panel in FIG. 11.
Figure 13:
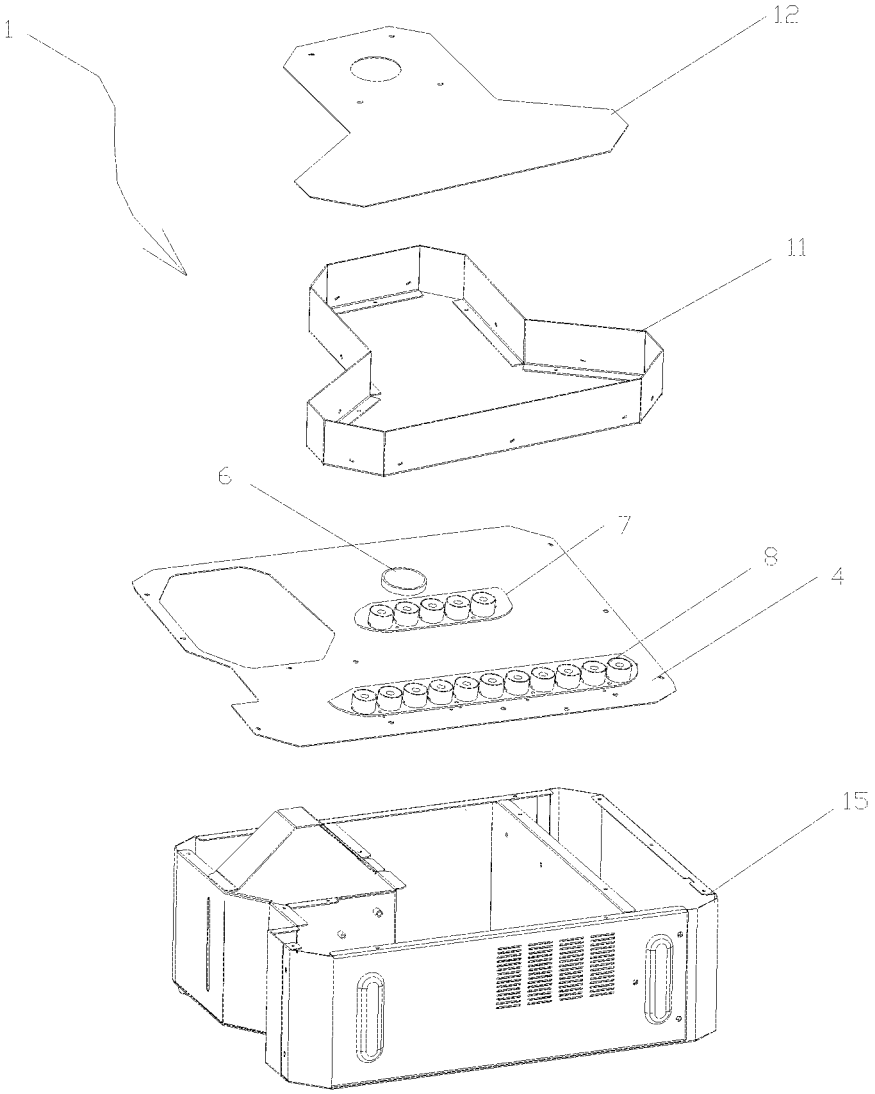
FIG. 13 is an exploded diagram of the machine case of Embodiment 3.
Figure 14:
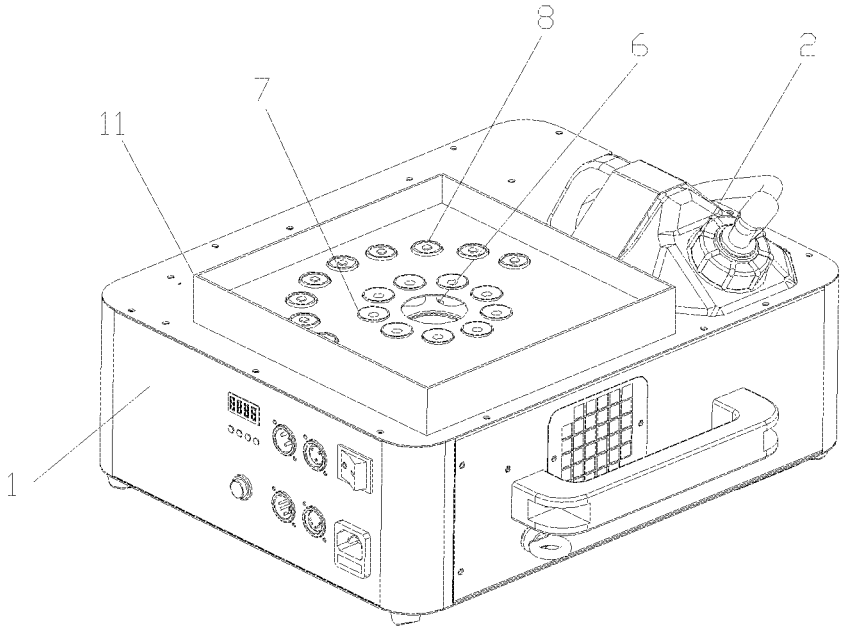
FIG. 14 is a schematic diagram showing the entire flame simulation stage fog spurting machine according to Embodiment 4.
Figure 15:
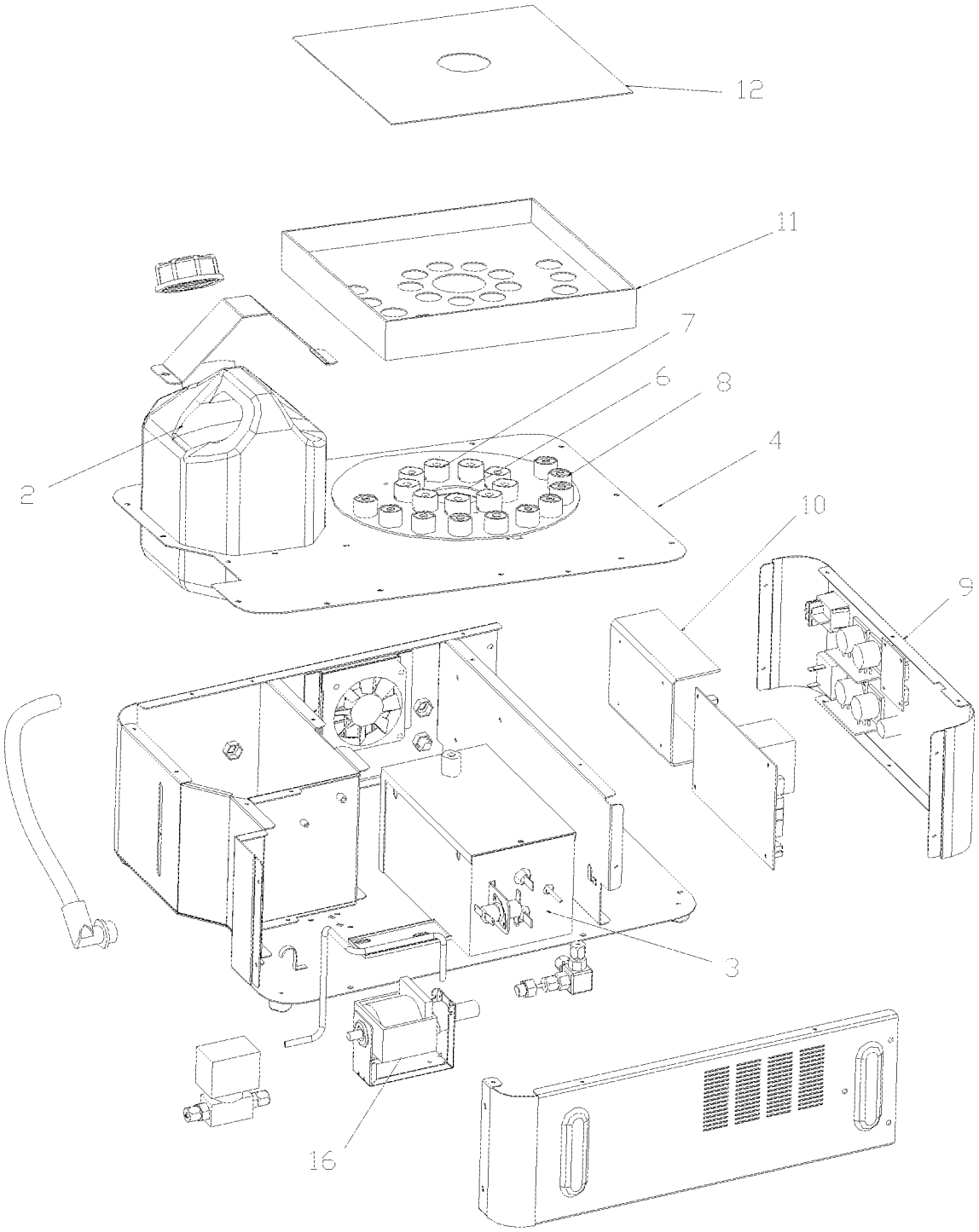
FIG. 15 is an exploded diagram of FIG. 14.
Figure 16:
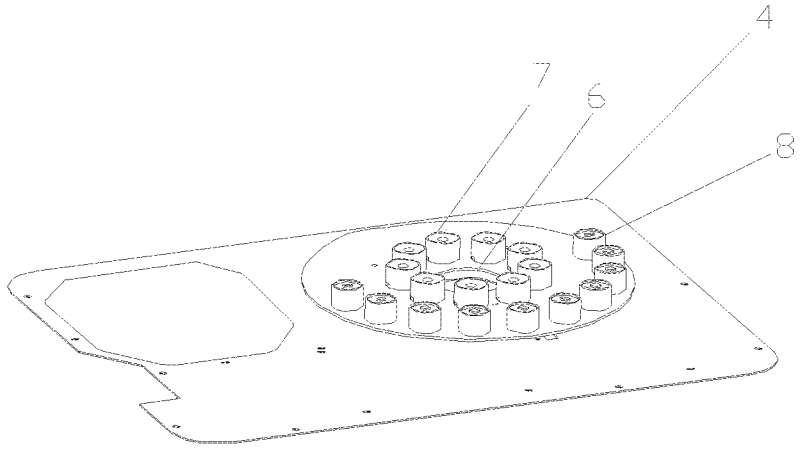
FIG. 16 is a structural schematic diagram of the spurting panel in FIG. 15.
Figure 17:
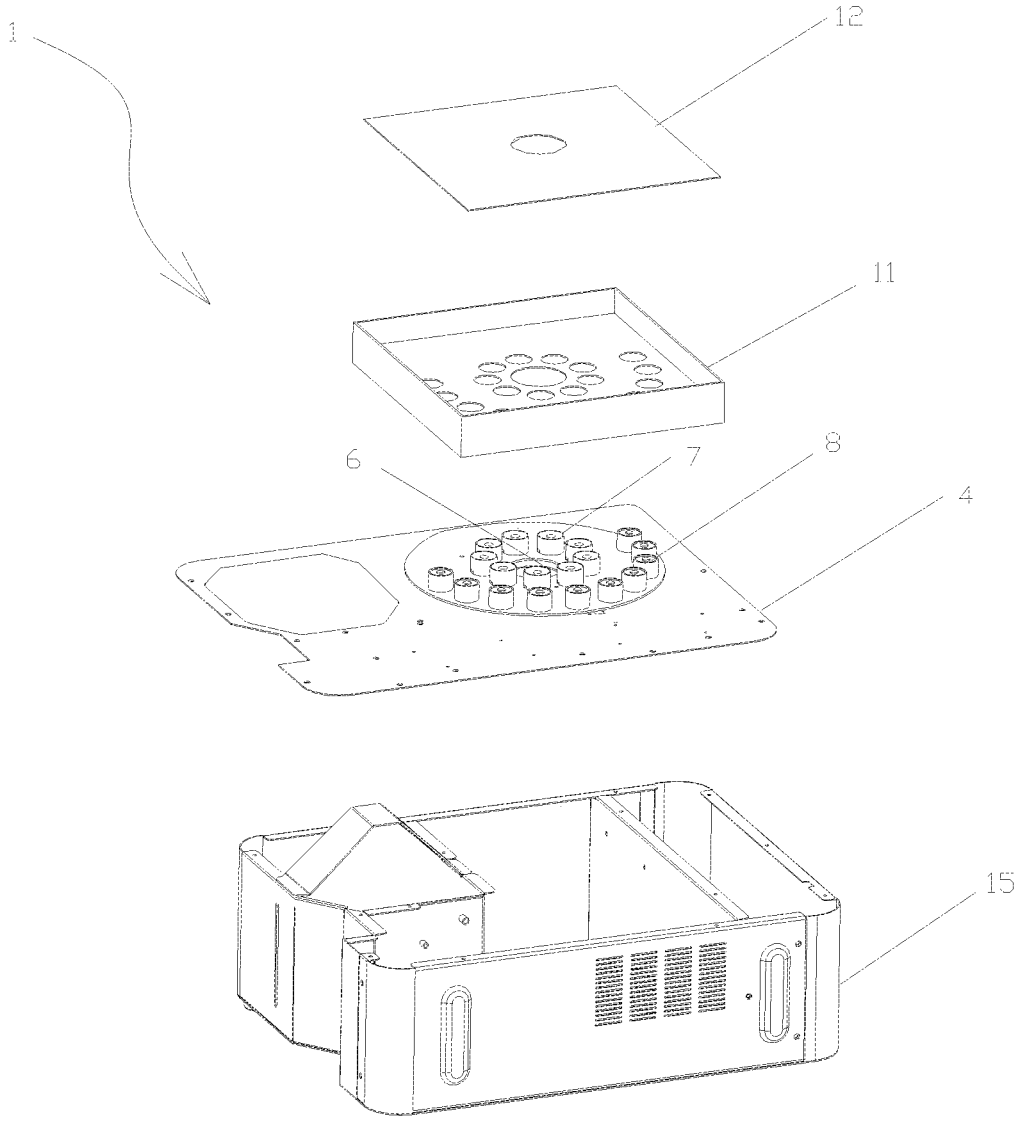
FIG. 17 is an exploded diagram of the machine case of Embodiment 4.

The present invention will be further described hereinafter in combination of the drawings and embodiments.

Embodiment 1

FIGS. 1-5 show the structure of a flame simulation stage fog spurting machine of Embodiment 1, which includes a spurting machine case 1. A fog juice bottle 2, a fog juice pump 16, a heater 3, a power module 10, and a control module 9 are mounted inside the spurting machine case 1. The input end of the fog juice pump 16 is connected to the fog juice bottle 2, and the output end of the fog juice pump 16 is connected to the heater 3. The spurting machine case 1 includes a case body 15 and a spurting panel 4 mounted on the case body 15. The spurting panel 4 is provided with a fog spurting hole 6 connected to the nozzle 5 on the heater 3 and an inner flame spotlight set 7 mounted on the spurting panel 4 and located around the fog spurting hole 6. An outer flame spotlight set 8 is further mounted on the spurting panel 4. A distance between the outer flame spotlight set 8 and the fog spurting hole 6 is greater than a distance between the inner flame spotlight set 7 and the fog spurting hole 6. The inner flame spotlight set 7, the outer flame spotlight set 8, and the control module 9 are electrically connected to the power module 10, respectively.

The inner flame spotlight set 7 and the outer flame spotlight set 8 are electrically connected to the control module 9, respectively. The control module 9 is configured to control the working status of the inner flame spotlight set 7 and the outer flame spotlight set 8.

The inner flame spotlight set 7 is annular. The inner flame spotlight set 7 includes nine LED spotlights in total. The distance between the set of LED spotlights and the center of the fog spurting hole 6 is 5 cm.

The outer flame spotlight set 8 is straight strip shaped, and there are 23 LED spotlights in total which are arranged in two rows. The minimum distance between the set of LED spotlights and the center of the fog spurting hole 6 is 20 cm.

In order not to affect the perfect effect of the fog channel flame due to the reason that the spotlights are visible to the audiences during use, a non-transparent lampshade 11 may be mounted on the spurting panel 4. The inner flame spotlight set 7 and the outer flame spotlight set 8 are both located inside the lampshade. The height of the lampshade 11 is slightly greater than the heights of the inner flame spotlight set 7 and the outer flame spotlight set 8.

The lampshade 11 is further provided with a non-transparent cover plate 13. The bottom surface of the cover plate 13 is appressed with the inner flame spotlight set 7 and the outer flame spotlight set 8. The cover plate 13 is provided with light-transmitting holes 14 matched with the fog spurting 6, the inner flame spotlight set 7, and the outer flame spotlight set 8 in position and size. The cover plate 13 is connected and mounted to the spurting panel 4 by fasteners.

In order to prevent the lampshade and the spotlights from stains such as dust, droplets, etc., the upper end surface of the cover plate 13 is further provided with a transparent protection plate 12. The transparent protection plate 12 is provided with a through hole matched with the fog spurting hole 6 in position and size. The transparent protection plate 12 is connected and mounted to the spurting panel 4 by fasteners.

When the flame simulation stage fog spurting machine is started up, the fog juice in the fog juice bottle 2 is driven to pass through the heater 3 quickly under the action of the fog juice pump, and is heated and rapidly gasified to form a large amount of white fog in the heater 3. The white fog is spurted out from the nozzle 5 of the heater in the form of fog channel. The spurted fog channel is illuminated by the inner flame spotlight set 7 to form an inner flame in visual sense, and the fog channel is illuminated by the outer flame spotlight set 8 to form a higher and wider outer flame in visual sense.

Embodiment 2

FIGS. 6-9 show the structure of a flame simulation stage fog spurting machine according to Embodiment 2, which includes a spurting machine case 1. A fog juice bottle 2, a fog juice pump 16, a heater 3, a power module 10, and a control module 9 are mounted inside the spurting machine case 1. The input end of the fog juice pump 16 is connected to the fog juice bottle 2, and the output end of the fog juice pump 16 is connected to the heater 3. The spurting machine case 1 includes a case body 15 and a spurting panel 4 mounted on the case body 15. The spurting panel 4 is provided with a fog spurting hole 6 connected to the nozzle 5 on the heater 3 and an inner flame spotlight set 7 mounted on the spurting panel 4 and located around the fog spurting hole 6. An outer flame spotlight set 8 is further mounted on the spurting panel 4. A distance between the outer flame spotlight set 8 and the fog spurting hole 6 is greater than a distance between the inner flame spotlight set 7 and the fog spurting hole 6. The inner flame spotlight set 7, the outer flame spotlight set 8, and the control module 9 are electrically connected to the power module 10, respectively. The inner flame spotlight set 7 and the outer flame spotlight set 8 are electrically connected to the control module 9, respectively. The control module 9 is configured to control the working status of the inner flame spotlight set 7 and the outer flame spotlight set 8.

The inner flame spotlight set 7 is annular. The inner flame spotlight set 7 includes nine LED spotlights in total. The distance between the set of LED spotlights and the center of the fog spurting hole 6 is 5 cm.

The outer flame spotlight set 8 is annular. The outer flame spotlight set 8 includes 18 LED spotlights in total. The distance between the set of LED spotlights and the center of the fog spurting hole 6 is 15 cm.

In order not to affect the perfect effect of the fog channel flame due to the reason that the spotlights are visible to the audiences during use, a non-transparent lampshade 11 may be mounted on the spurting panel 4. The inner flame spotlight set 7 and the outer flame spotlight set 8 are both located inside the lampshade. The height of the lampshade 11 is slightly greater than the heights of the inner flame spotlight set 7 and the outer flame spotlight set 8.

The lampshade 11 is further provided with a non-transparent cover plate 13. The bottom surface of the cover plate 13 is appressed with the inner flame spotlight set 7 and the outer flame spotlight set 8. The cover plate 13 is provided with light-transmitting holes 14 matched with the fog spurting 6, the inner flame spotlight set 7, and the outer flame spotlight set 8 in position and size. The cover plate 13 is connected and mounted to the spurting panel 4 by fasteners.

When the flame simulation stage fog spurting machine is started up, the fog juice in the fog juice bottle 2 is driven to pass through the heater 3 quickly under the action of the fog juice pump, and is heated and rapidly gasified to form a large amount of white fog in the heater 3. The white fog is spurted out from the nozzle 5 of the heater in the form of fog channel. The spurted fog channel is illuminated by the inner flame spotlight set 7 to form an inner flame in visual sense, and the fog channel is illuminated by the outer flame spotlight set 8 to form a higher and wider outer flame in visual sense.

Embodiment 3

FIGS. 10-13 show the structure of a flame simulation stage fog spurting machine according to Embodiment 3, which includes a spurting machine case 1. A fog juice bottle 2, a fog juice pump 16, a heater 3, a power module 10, and a control module 9 are mounted inside the spurting machine case 1. The input end of the fog juice pump 16 is connected to the fog juice bottle 2, and the output end of the fog juice pump 16 is connected to the heater 3. The spurting machine case 1 includes a case body 15 and a spurting panel 4 mounted on the case body 15. The spurting panel 4 is provided with a fog spurting hole 6 connected to the nozzle 5 on the heater 3 and an inner flame spotlight set 7 mounted on the spurting panel 4 and located around the fog spurting hole 6. An outer flame spotlight set 8 is further mounted on the spurting panel 4. A distance between the outer flame spotlight set 8 and the fog spurting hole 6 is greater than a distance between the inner flame spotlight set 7 and the fog spurting hole 6. The inner flame spotlight set 7, the outer flame spotlight set 8, and the control module 9 are electrically connected to the power module 10, respectively. The inner flame spotlight set 7 and the outer flame spotlight set 8 are electrically connected to the control module 9, respectively. The control module 9 is configured to control the working status of the inner flame spotlight set 7 and the outer flame spotlight set 8.

The inner flame spotlight set 7 is straight strip shaped. The inner flame spotlight set 7 includes five LED spotlights in total. The distance between the set of LED spotlights and the center of the fog spurting hole 6 is 4 cm.

The outer flame spotlight set 8 is straight strip shaped, and there are eleven LED spotlights in total which are arranged in one row. The minimum distance between the set of LED spotlights and the center of the fog spurting hole 6 is 18 cm.

In order not to affect the perfect effect of the fog channel flame due to the reason that the spotlights are visible to the audience during use, a non-transparent lampshade 11 may be mounted on the spurting panel 4. The inner flame spotlight set 7 and the outer flame spotlight set 8 are both located inside the lampshade. The height of the lampshade 11 is slightly greater than the heights of the inner flame spotlight set 7 and the outer flame spotlight set 8.

In order to prevent the lampshade and the spotlights from stains such as dust, droplets, etc., an upper end surface of the lampshade 11 is further provided with a transparent protection plate 12. The transparent protection plate 12 is provided with a through hole matched the fog spurting hole 6 in position and size. The transparent protection plate 12 is connected and mounted to the spurting panel by fasteners.

When the flame simulation stage fog spurting machine is started up, the fog juice in the fog juice bottle 2 is driven to pass through the heater 3 quickly under the action of the fog juice pump, and is heated and rapidly gasified to form a large amount of white fog in the heater 3. The white fog is spurted out from the nozzle 5 of the heater in the form of fog channel. The spurted fog channel is illuminated by the inner flame spotlight set 7 to form an inner flame in visual sense, and the fog channel is illuminated by the outer flame spotlight set 8 to form a higher and wider outer flame in visual sense.

Embodiment 4

FIGS. 14-17 show the structure of a flame simulation stage fog spurting machine according to Embodiment 4, which includes a spurting machine case 1. A fog juice bottle 2, a fog juice pump 16, a heater 3, a power module 10, and a control module 9 are mounted inside the spurting machine case 1. The input end of the fog juice pump 16 is connected to the fog juice bottle 2, and the output end of the fog juice pump 16 is connected to the heater 3. The spurting machine case 1 includes a case body 15 and a spurting panel 4 mounted on the case body 15. The spurting panel 4 is provided with a fog spurting hole 6 connected to the nozzle 5 on the heater 3 and an inner flame spotlight set 7 mounted on the spurting panel 4 and located around the fog spurting hole 6. An outer flame spotlight set 8 is further mounted on the spurting panel 4. A distance between the outer flame spotlight set 8 and the fog spurting hole 6 is greater than a distance between the inner flame spotlight set 7 and the fog spurting hole 6. The inner flame spotlight set 7, the outer flame spotlight set 8, and the control module 9 are electrically connected to the power module 10, respectively. The inner flame spotlight set 7 and the outer flame spotlight set 8, and the control module 9 are electrically connected to the power module 10, respectively. The inner flame spotlight set 7 and the outer flame spotlight set 8 are electrically connected to the control module 9, respectively. The control module 9 is configured to control the working status of the inner flame spotlight set 7 and the outer flame spotlight set 8.

The inner flame spotlight set 7 is annular. The inner flame spotlight set 7 includes nine LED spotlights in total. The distance between the set of LED spotlights and the center of the fog spurting hole 6 is 6 cm.

The outer flame spotlight set 8 is semicircular, and includes ten LED spotlights in total. The minimum distance between the set LED spotlights and the center of the fog spurting hole 6 is 15 cm.

In order not to affect the perfect effect of the fog channel flame due to the reason that the spotlights are visible to the audience during use, a non-transparent lampshade 11 may be mounted on the spurting panel 4. The inner flame spotlight set 7 and the outer flame spotlight set 8 are both located inside the lampshade. The height of the lampshade 11 is slightly greater than the heights of the inner flame spotlight set 7 and the outer flame spotlight set 8.

The lampshade 11 is further provided with a non-transparent cover plate 13. The cover plate 13 is located above the inner flame spotlight set 7 and the outer flame spotlight set 8. The cover plate 13 is provided with light-transmitting holes 14 matched with the fog spurting 6, the inner flame spotlight set 7, and the outer flame spotlight set 8 in position and size. The cover plate 13 is connected and mounted to the spurting panel 4 by fasteners.

In order to prevent the lampshade and the spotlights from stains such as dust, droplets, etc., the upper end surface of the cover plate 13 is further provided with a transparent protection plate 12. The transparent protection plate 12 is provided with a through hole matched with the fog spurting hole 6 in position and size. The transparent protection plate 12 is connected and mounted to the spurting panel 4 by fasteners.

When the flame simulation stage fog spurting machine is started up, the fog juice in the fog juice bottle 2 is driven to pass through the heater 3 quickly under the action of the fog juice pump, and is heated and rapidly gasified to form a large amount of white fog in the heater 3. The white fog is spurted out from the nozzle 5 of the heater in the form of fog channel. The spurted fog channel is illuminated by the inner flame spotlight set 7 to form an inner flame in visual sense, and the fog channel is illuminated by the outer flame spotlight set 8 to form a higher and wider outer flame in a visual sense.

Embodiment 5

Figure 18:
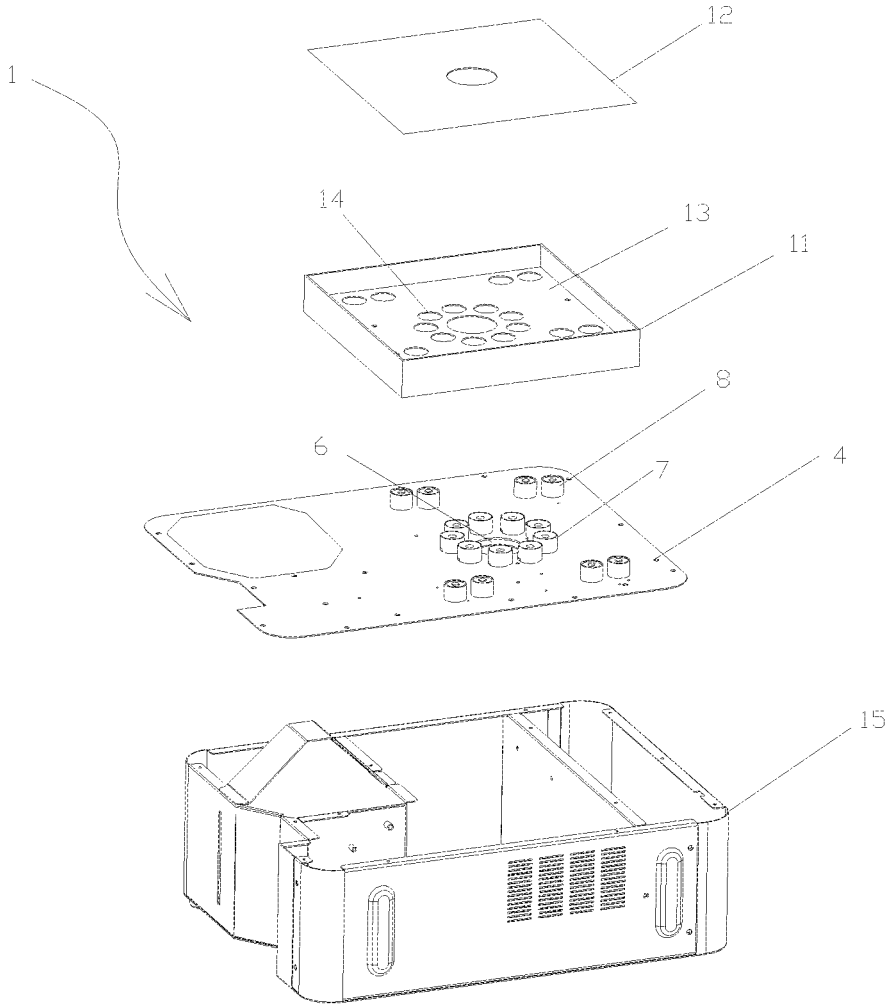
FIG. 18 is an exploded diagram of the machine case of Embodiment 5.

FIG. 18 shows the structure according to Embodiment 5 of the present invention. Embodiment 5 is different than Embodiment 2 in that the inner flame spotlight set 7 of the flame simulation stage fog spurting machine, the machine case, and the spurting panel thereof is annular. The inner flame spotlight set 7 includes nine LED spotlights in total. The distance between the set of LED spotlights and the center of the fog spurting hole 6 is 6 cm.

The spurting panel 4 is rectangular. The outer flame spotlight set 8 is composed of eight LED spotlights. Every two of the eight spotlights form a group, and the groups are distributed at the four corners of the spurting panel. The minimum distance between each group of LED spotlights and the center of the fog spurting hole 6 is 20 cm.

In order not to affect the perfect effect of the fog channel flame due to the reason that the spotlights are visible to the audiences during use, a non-transparent lampshade 11 may be mounted on the spurting panel 4. The inner flame spotlight set 7 and the outer flame spotlight set 8 are both located inside the lampshade. The height of the lampshade 11 is slightly greater than the heights of the inner flame spotlight set 7 and the outer flame spotlight set 8.

The lampshade 11 is further provided with a non-transparent cover plate 13. The cover plate 13 is located above the inner flame spotlight set 7 and the outer flame spotlight set 8. The cover plate 13 is provided with light-transmitting holes 14 matched with the fog spurting 6, the inner flame spotlight set 7, and the outer flame spotlight set 8 in position and size. The cover plate 13 is connected and mounted to the spurting panel 4 by fasteners.

In order to prevent the lampshade and the spotlights from stains such as dust, droplets, etc., the upper end surface of the cover plate 13 is further provided with a transparent protection plate 12. The transparent protection plate 12 is provided with a through hole matched with the fog spurting hole 6 in position and size. The transparent protection plate 12 is connected and mounted to the spurting panel 4 by fasteners.

The flame simulation stage fog spurting machine, and the machine case and spurting panel thereof of the present invention are not limited to the above embodiments. All the technical solutions disclosed in the specification and the claims can be implemented. For example, the spotlights may also be light bulbs, laser spotlights, or other light sources, the cover plate may be mounted on the lampshade or integrally formed with the lampshade, the transparent protection plate may be mounted on the lampshade or integrally formed with the lampshade, and the like.

Besides, various other corresponding changes and modifications may be derived by those skilled in the art according to the above-mentioned technical solutions and ideas, and all these changes and modification should be considered as falling within the scope of the appended claims of the present invention.

What is claimed is:

1. A spurting panel for a flame simulation stage fog spurting machine, comprising: a fog spurting hole, an outer flame spotlight set and an inner flame spotlight set, wherein the inner flame spotlight set is mounted on the spurting panel and located around the fog spurting hole;

a distance between the outer flame spotlight set and the fog spurting hole is greater than a distance between the inner flame spotlight set and the fog spurting hole;

wherein, a non-transparent lampshade is mounted on the spurting panel;

the inner flame spotlight set and the outer flame spotlight set are located inside the non-transparent lampshade;

a height of the non-transparent lampshade is greater than or equal to heights of the inner flame spotlight set and the outer flame spotlight set;

wherein, the non-transparent lampshade is further provided with a non-transparent cover plate;

the non-transparent cover plate is located above the inner flame spotlight set and the outer flame spotlight set, or a bottom surface of the non-transparent cover plate is appressed with the inner flame spotlight set and the outer flame spotlight set;

the non-transparent cover plate is provided with light-transmitting holes matched with positions and sizes of the fog spurting hole, the inner flame spotlight set, and the outer flame spotlight set; and the non-transparent cover plate is mounted on the non-transparent lampshade, integrally formed with the non-transparent lampshade, or connected and mounted to the spurting panel by fasteners.

2. The spurting panel for the flame simulation stage fog spurting machine according to claim 1, wherein the inner flame spotlight set comprises at least two spotlights;

the outer flame spotlight set comprises at least two spotlights;

the inner flame spotlight set is annular shaped; and the outer flame spotlight set is straight strip shaped.

3. The spurting panel for the flame simulation stage fog spurting machine according to claim 1, wherein an upper end surface of the non-transparent cover plate is further provided with a transparent protection plate;

the transparent protection plate is provided with a through hole matched with the position and the size of the fog spurting hole; and the transparent protection plate is mounted on the non-transparent lampshade, integrally formed with the non-transparent lampshade, or connected and mounted to the spurting panel by fasteners.

4. A machine case for a flame simulation stage fog spurting machine, comprising a case body and a spurting panel, wherein the spurting panel comprises a fog spurting hole, an outer flame spotlight set and an inner flame spotlight set; the inner flame spotlight set is mounted on the spurting panel and located around the fog spurting hole;

a distance between the outer flame spotlight set and the fog spurting hole is greater than a distance between the inner flame spotlight set and the fog spurting hole; wherein, a non-transparent lampshade is mounted on the spurting panel;

the inner flame spotlight set and the outer flame spotlight set are located inside the non-transparent lampshade;

a height of the non-transparent lampshade is greater than or equal to heights of the inner flame spotlight set and the outer flame spotlight set;

wherein, the non-transparent lampshade is further provided with a non-transparent cover plate;

the non-transparent cover plate is located above the inner flame spotlight set and the outer flame spotlight set, or a bottom surface of the non-transparent cover plate is appressed with the inner flame spotlight set and the outer flame spotlight set;

the non-transparent cover plate is provided with light-transmitting holes matched with positions and sizes of the fog spurting hole, the inner flame spotlight set, and the outer flame spotlight set; and the non-transparent cover plate is mounted on the non-transparent lampshade, integrally formed with the non-transparent lampshade, or connected and mounted to the spurting panel by fasteners.

5. The machine case for the flame simulation stage fog spurting machine according to claim 4, wherein the inner flame spotlight set comprises at least two spotlights;

the outer flame spotlight set comprises at least two spotlights;

the inner flame spotlight set is arc-shaped, annular shaped, or straight strip shaped; and the outer flame spotlight set is arc-shaped, annular shaped, or straight strip shaped.

6. The machine case for the flame simulation stage fog spurting machine according to claim 4, wherein an upper end surface of the non-transparent cover plate is further provided with a transparent protection plate;

the transparent protection plate is provided with a through hole matched with the position and the size of the fog spurting hole; and the transparent protection plate is mounted on the non-transparent lampshade, integrally formed with the non-transparent lampshade, or connected and mounted to the spurting panel by fasteners.

7. A flame simulation stage fog spurting machine, comprising:

a spurting machine case; wherein a fog juice bottle, a fog juice pump, a fog juice heater, a power module, and a control module are mounted inside the spurting machine case, an input end of the fog juice pump is connected to the fog juice bottle, an output end of the fog juice pump is connected to the heater;

the spurting machine case comprises a case body and a spurting panel mounted on the case body, wherein, the spurting panel comprises a fog spurting hole connected to a nozzle on the heater, an outer flame spotlight set and an inner flame spotlight set; the inner flame spotlight set is mounted on the spurting panel and located around the fog spurting hole;

a distance between the outer flame spotlight set and the fog spurting hole is greater than a distance between the inner flame spotlight set and the fog spurting hole;

the fog juice pump, the inner flame spotlight set, the outer flame spotlight set, and the control module are electrically connected to the power module, respectively;

the fog juice pump, the inner flame spotlight set, and the outer flame spotlight set are electrically connected to the control module, respectively; and the control module is configured to control working status of the fog juice pump, the inner flame spotlight set, and the outer flame spotlight set;

a non-transparent lampshade is mounted on the spurting panel;

the inner flame spotlight set and the outer flame spotlight set are located inside the non-transparent lampshade;

a height of the non-transparent lampshade is greater than or equal to heights of the inner flame spotlight set and the outer flame spotlight set;

wherein, the non-transparent lampshade is further provided with a non-transparent cover plate;

the non-transparent cover plate is located above the inner flame spotlight set and the outer flame spotlight set, or a bottom surface of the non-transparent cover plate is appressed with the inner flame spotlight set and the outer flame spotlight set;

the non-transparent cover plate is provided with light-transmitting holes matched with positions and sizes of the fog spurting hole, the inner flame spotlight set, and the outer flame spotlight set; and the non-transparent cover plate is mounted on the non-transparent lampshade, integrally formed with the non-transparent lampshade, or connected and mounted to the spurting panel by fasteners.

8. The flame simulation stage fog spurting machine according to claim 7, wherein the inner flame spotlight set comprises at least two spotlights;

the outer flame spotlight set comprises at least two spotlights;

the inner flame spotlight set is annular shaped; and the outer flame spotlight set is straight strip shaped.

9. The flame simulation stage fog spurting machine according to claim 7, wherein an upper end surface of the non-transparent cover plate is further provided with a transparent protection plate;

the transparent protection plate is provided with a through hole matched with the position and the size of the fog spurting hole; and the transparent protection plate is mounted on the non-transparent lampshade, integrally formed with the non-transparent lampshade, or connected and mounted to the spurting panel by fasteners.

* * * * *